US005619099A

United States Patent [19]

Nakamura et al.

[11] Patent Number: 5,619,099

[45] Date of Patent: Apr. 8, 1997

[54] ELECTRON TUBES USING INSULATION MATERIAL CONTAINING LITTLE ALKALI METAL

[75] Inventors: Kimitsugu Nakamura; Masayoshi Sahara; Atushi Ishikawa; Chiyoshi Okuyama; Junichi Takeuchi, all of Hamamatsu, Japan

[73] Assignee: Hamamatsu Photonics K.K., Shizuoka-ken, Japan

[21] Appl. No.: 492,703

[22] Filed: Jun. 20, 1995

[30] Foreign Application Priority Data

Jun. 29, 1994 [JP] Japan ..... 6-148196

[51] Int. Cl.[6] ..... H01J 40/16

[52] U.S. Cl. ..... 313/532; 313/533

[58] Field of Search ..... 313/532, 533, 313/534, 535, 536, 538, 542

[56] References Cited

U.S. PATENT DOCUMENTS 4,333,081 6/1982 Butterwick ..... 313/350

4,604,545 8/1986 McDonie et al. ..... 313/105

FOREIGN PATENT DOCUMENTS 0571201 11/1993 European Pat. Off. .

62-150644 7/1987 Japan .

*Primary Examiner*—Sandra L. O'Shea

*Assistant Examiner*—Vip Patel

*Attorney, Agent, or Firm*—Sughrue, Mion, Zinn, Macpeak & Seas

[57] ABSTRACT

Support electrodes are provided for individually supporting a plurality of dynodes arranged inside of a vessel of an electron tube, such as photomultiplier tube. A black spacer formed from a ceramic material is disposed between the support electrodes. The black spacers are formed with elemental composition having content of MnO suppressed to 3 wt % or less. Current leaks, which are the cause of dark current, and abnormal generations of light during photomultiplication can be reduced, thereby improving the signal-to-noise ratio of the electron tube.

15 Claims, 6 Drawing Sheets

FIG. 4

| | ELEMENTARY COMPOSITION RATIO | | | | | | | | ALKALI ABSORPTION X-RAY INTENSITY | | |
|---|---|---|---|---|---|---|---|---|---|---|---|
| | MnO | $Cr_2O_3$ | $Fe_2O_3$ | $T_iO_2$ | MgO | CaO | $Al_2O_3$ | $SiO_2$ | Rb | Cs | K |
| SAMPLE 1 | — | — | 0.07 | — | — | — | 96.62 | 3.3 | 0.029 | 0.006 | 0.05 |
| SAMPLE 2 | — | 2.63 | 0.03 | 1.19 | 0.16 | 0.76 | 71.83 | 8.12 | 0.0395 | 0.004 | 0.048 |
| SAMPLE 3 | 2.7 | — | 1.58 | 1.85 | — | 0.2 | 89.85 | 3.62 | 0.0716 | 0.0078 | 0.1089 |
| SAMPLE 4 | 3.99 | — | 1.7 | 15.8 | — | 0.09 | 71.83 | 6.4 | 0.688 | 0.037 | 0.112 |
| SAMPLE 5 | 6.3 | — | 3.9 | 16.69 | — | 0.16 | 67.65 | 5.2 | 1.868 | 0.046 | 0.92617 |

ELECTRON TUBES USING INSULATION MATERIAL CONTAINING LITTLE ALKALI METAL

BACKGROUND OF THE INVENTION

1. Field of the Invention

The present invention relates generally to electron tubes, such as photomultiplier tubes, image intensifiers, and more particularly to an electron tube having a photocathode whose surface is deposited with alkali metal upon confining alkali metal vapor in the tube.

2. Description of the Related Art

Ceramics are generally used in a photomultiplier tube to electrically insulate a photocathode, dynodes, and an anode. Japanese Laid-Open Patent Publication No. SHO-62-150644 proposes coloring the ceramics, for example, black, to reduce the dark current of the photomultiplier tube.

The ceramics can be colored starting either with manganese (Mn) which is a reddish coloring dye, or with cobalt (Co) which is a bluish coloring dye. Cobalt is several times more expensive than manganese and also gives bluish tint to black-colored ceramics. Therefore, ceramics colored black with manganese are primarily used in LSI packages and vacuum tubes.

A ceramic is typically composed of $Al_2O_3$, Si, Ti, Mn, Fe, Cr, and the like. Generally, Fe, Cr, Co, Mn, Ni, Cu, and the like are used to color the ceramic.

The surface of photocathode in a photomultiplier tube is formed by introducing an alkali metal vapor into an electron tube. The present inventors recognized that a great deal of alkali metal vapor were required to deposit the alkali metal on the surface of the photocathode. The inventors found that the need for a great deal of alkali metal vapor resulted from absorption of the metal vapor by colored ceramics which insulate and support the various electrodes. However, it is desirable to make this type of electron tube using only a minimal amount of alkali metal, because the lower the alkali metal content, the better the characteristics relating to photoelectric conversion sensitivity and dark current. Service life of the photomultiplier is also prolonged if the amount of alkali metal contained in the ceramics is reduced.

SUMMARY OF THE INVENTION

The present invention has been made to solve the above-described problems, and accordingly it is an object of the present invention to suppress the amount of alkali metal vapor introduced into the tube to deposit alkali metal on the surface of a photocathode to a minimal level.

An electron tube according to the present invention has a photocathode formed by depositing alkali metal vapor on the surface thereof, wherein a plurality of electrodes each applied with a predetermined potential for controlling emission of electrons and an insulation material electrically insulating the electrodes from each other are arranged inside the electron tube, and wherein the insulation material has a MnO content of 3 wt % or less.

The amount of alkali metal adsorbed by the insulation material can be sufficiently suppressed by coloring the insulation material using MnO content of 3 wt % or less. As a result, the amount of alkali metal introduced into the electron tube can be suppressed to a minimal amount and an excellent signal-to-noise ratio can be obtained for the electron tube.

BRIEF DESCRIPTION OF THE DRAWINGS

The particular features and advantages of the invention as well as other objects will become more apparent from the following description taken in connection with the accompanying drawings, in which:

FIG. 4 is a Table showing results of measurements;

DETAILED DESCRIPTION OF THE PREFERRED EMBODIMENTS

An embodiment of the present invention will be described while referring to the accompanying drawings.

Figure 1:
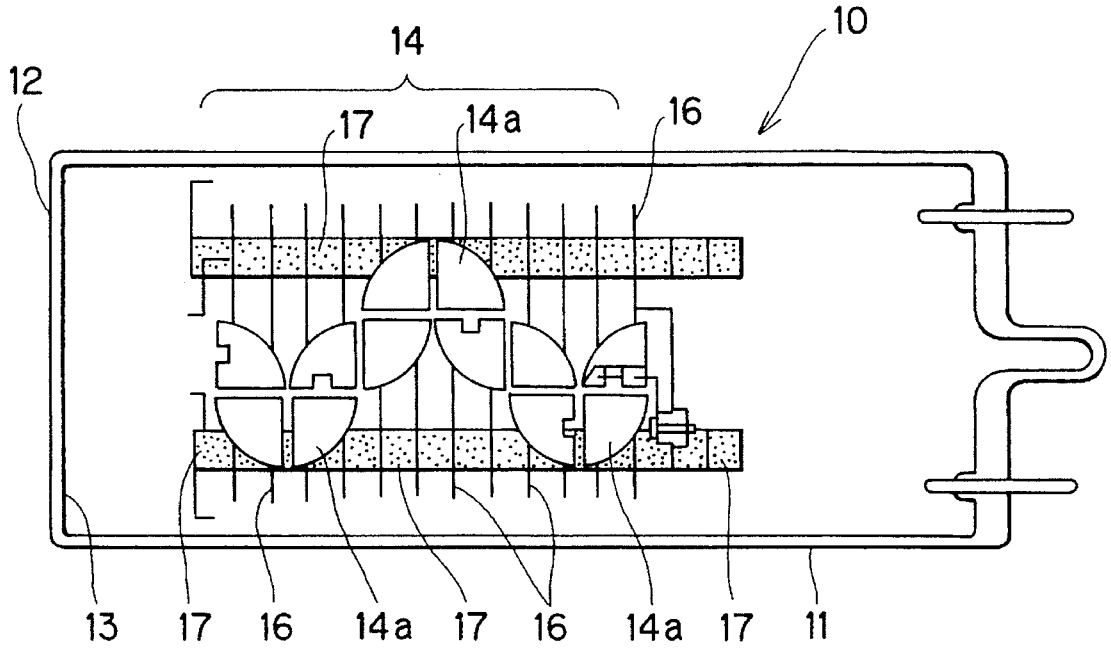
FIG. 1 is a cross-sectional view schematically showing internal structure of a photomultiplier tube as an example of an electron tube according to the present invention.

A preferred embodiment of the present invention is directed to a photomultiplier tube which is one of electron tubes. FIG. 1 schematically shows an arrangement of a typical photomultiplier tube. The photomultiplier tube 10 includes a photocathode 13, an electron multiplier portion 14, and an anode 15, which are located inside a vacuum envelope 11. The photocathode 13 is an electrode used for obtaining photoelectric emission when irradiated. The photocathode 13 produces photoelectron upon receipt of radiant energy in the ultraviolet, visible, and near infrared regions of the electromagnetic spectrum from an input window 12. The electron multiplier portion 14 is composed of a multistage "box-type" dynodes 14*a* which have "secondary-emission amplification" capability. Specifically, photoelectrons produced at the photocathode 13 are emitted and directed by an appropriate electric field to a first stage dynode. A number of secondary electrons are emitted at this dynode for each impinging primary photoelectron. These secondary electrons in turn are directed to a second stage dynode and so on until a final gain is achieved. The electrons from the last dynode are collected by an anode 15 which provides the signal current that is read out.

Plate-shaped support electrodes 16 are provided for supporting each dynode 14*a*. Each dynode 14*a* and the support electrodes 16 supporting the dynode 14*a* are electrically connected.

Figure 2:
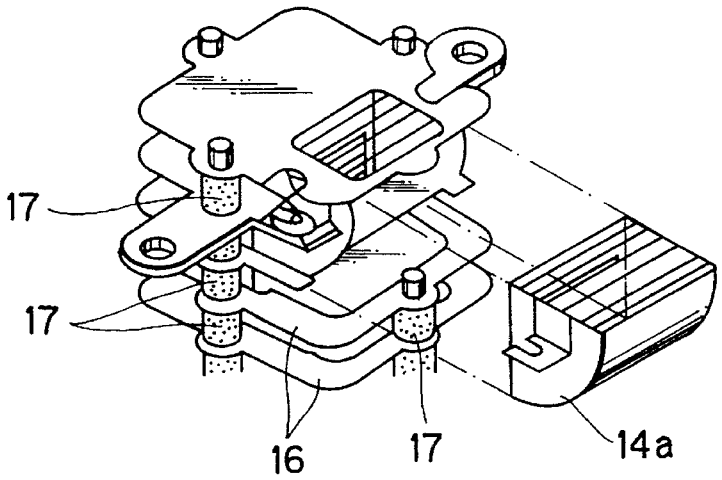
FIG. 2 is a perspective view showing a portion of the photomultiplier tube of FIG. 1.

A black-colored spacer 17 made of a ceramic insulation material is positioned between adjacent support electrodes 16. The support electrodes 16 and the anode 15 are supported and fixed on the vacuum envelope 11 by a plurality of spacers 17 (see FIG. 2). The ceramic material forming the spacers 17 has elemental composition including MnO content of 3% or more by weight.

This MnO content was determined based on the following tests.

Figure 3:
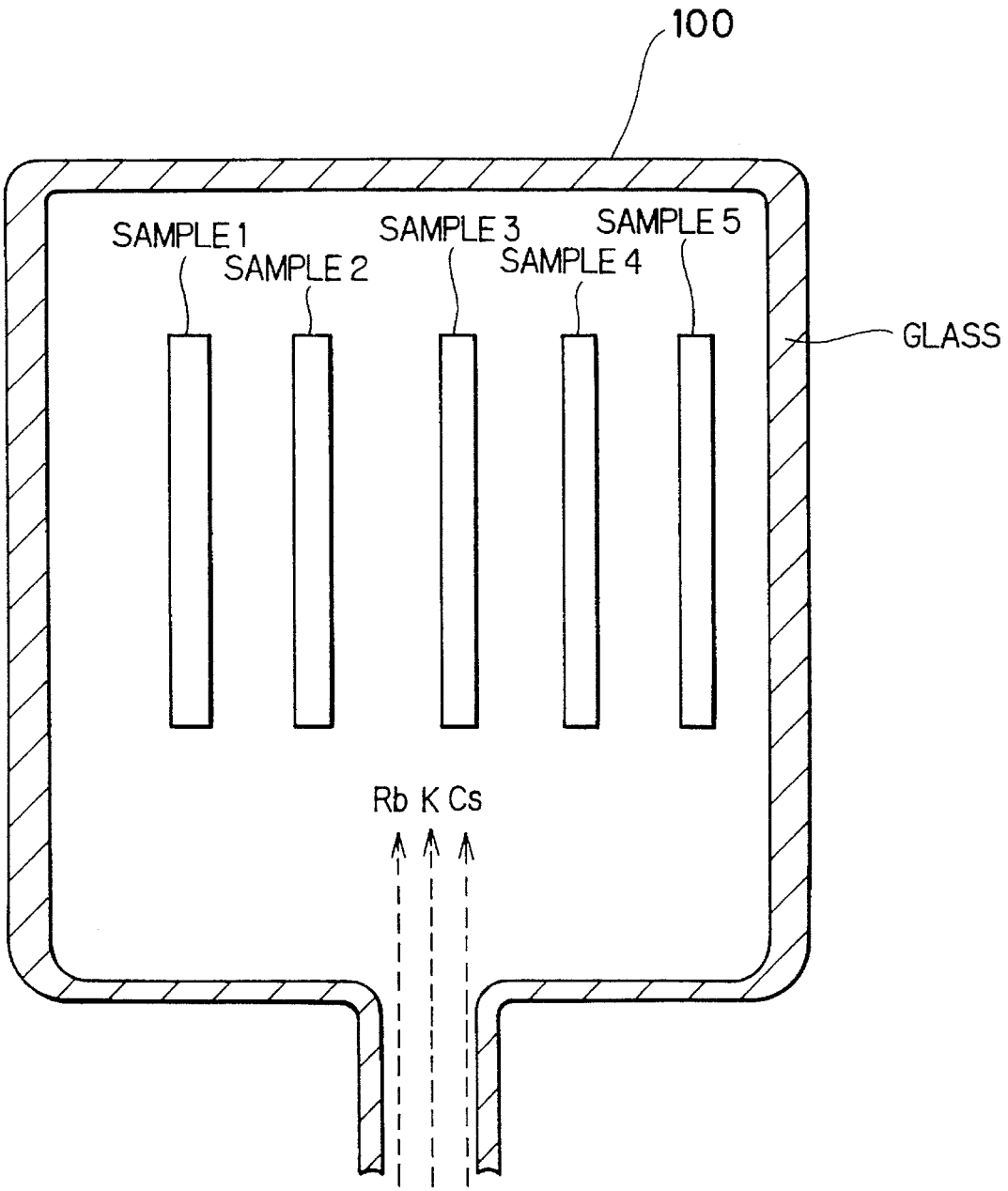
FIG. 3 is an explanatory diagram showing samples used during measurements.

Samples 1 through 5 of colored ceramics, which correspond to the black-colored spacers, are disposed interiorly of a glass vessel 100 as shown in FIG. 3. An elemental composition ratio of each of the samples 1 through 5 is shown in FIG. 4. The elements included in each sample are added to the samples at the time of production of the ceramics.

Next, metal vapor of potassium (K), rubidium (Rb), and caesium (Cs) which are alkali metals used for depositing on the surface of the photocathode 13 are introduced into the glass vessel 100. Afterward, the glass vessel 100 is evacuated to a vacuum of about $10^{-7}$ torr and then sealed.

Next. the samples 1 through 5 are taken out from the glass vessel 100 and the amount of alkali adsorbed near the surface of each sample is investigated using an X-ray fluorescence spectrometer. This device first irradiates each sample with X rays and investigates the energy distribution of the generated X rays. The elemental compositions of the sample can be determined from the detected energy values. Also, the amount of content in each elemental composition can be detected from the intensity of the fluorescent X rays.

Figure 5:
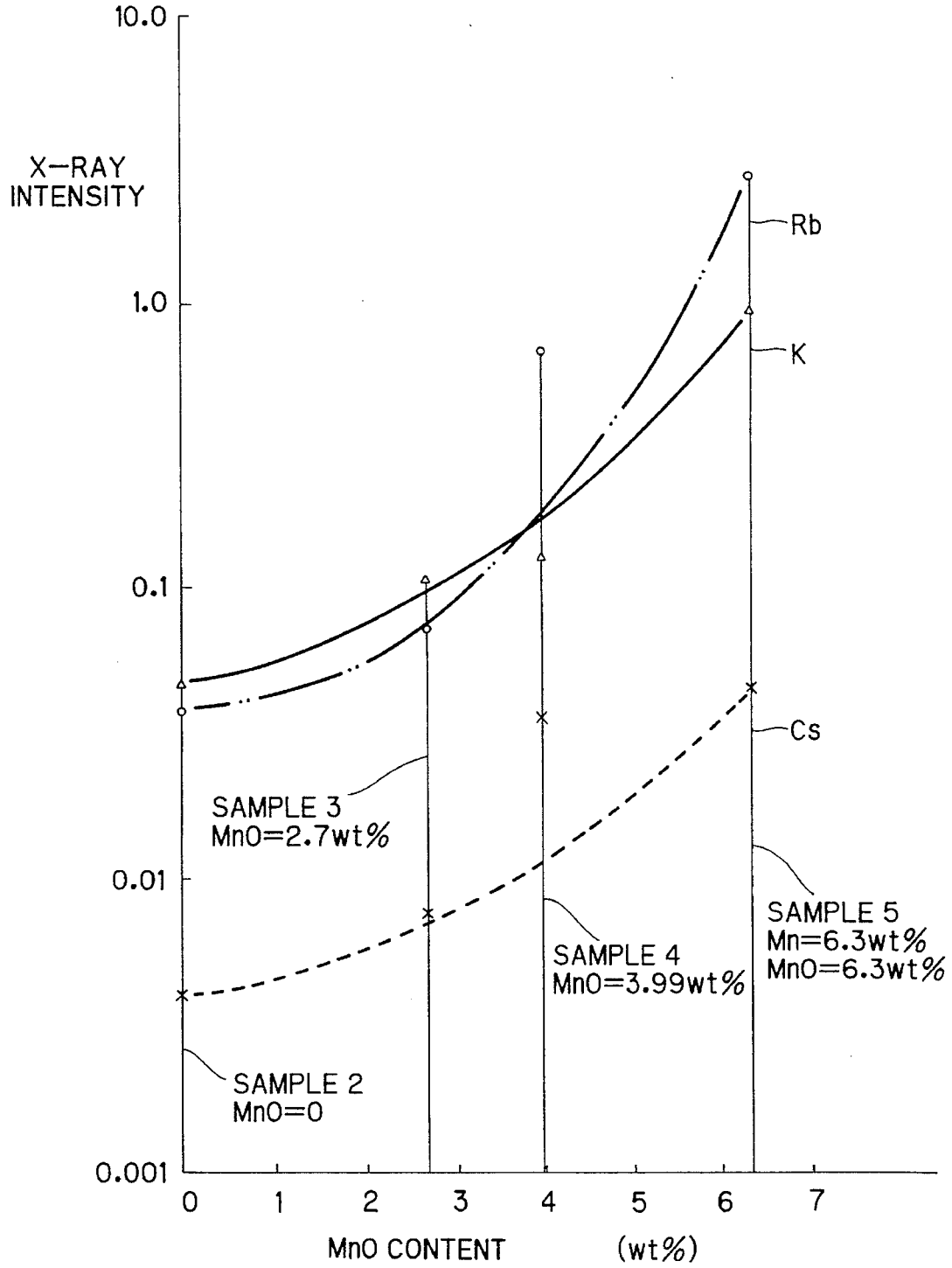
FIG. 5 is a graph showing results of measurements.

The results of these measurements are shown at the right-hand side of the table in FIG. 4. This table shows the elemental composition of each of the samples 1 through 5 and also the corresponding amount of adsorbed alkali as determined by the fluorescent X-ray analysis and characteristic X-ray intensity. FIG. 5 is a graph showing the relationship between the results of these measurements and the amount of MnO contained in each colored ceramic material. It can seen in this graph that when the MnO content exceeds 3 wt %, the amount of adsorbed alkali increases greatly in the case of K, Rb, and Cs.

Photomultiplier tubes with colored spacers having MnO content of 3 wt % or less showed less dark current than photomultiplier tubes with colored spacers having MnO content of more than 3 wt %. Dark current is a current flowing in the cathode circuit or in the anode circuit in the absence of light or radiation in the spectrum to which the photomultiplier is sensitive. One reason for the reduction of the dark current is that the MnO, which is strongly reactive with alkali metals, is reduced or completely removed during production of the photomultiplier tubes. During the measurements, the amount of alkali, that is, K, Cs, Rb, and the like, confined in the vacuum envelope was reduced by half.

Leak currents or unusual illumination, which is the source of dark current, generated during photomultiplication was reduced to one quarter or one sixth. Dark counts were also reduced.

Figure 7A:
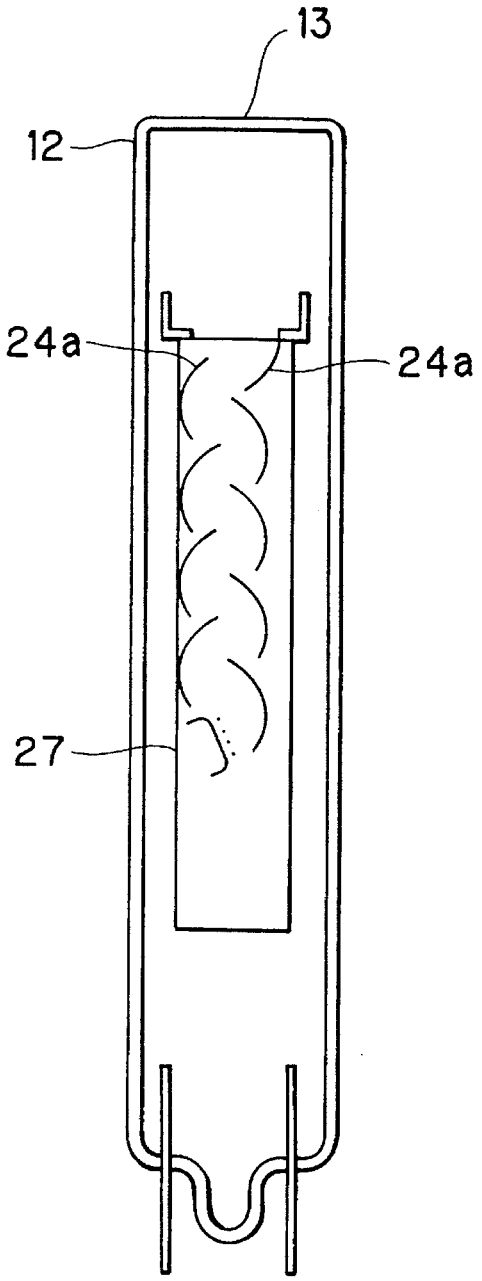
FIG. 7A is a schematic cross-sectional view showing a photomultiplier tube with an insulator.
Figure 7B:
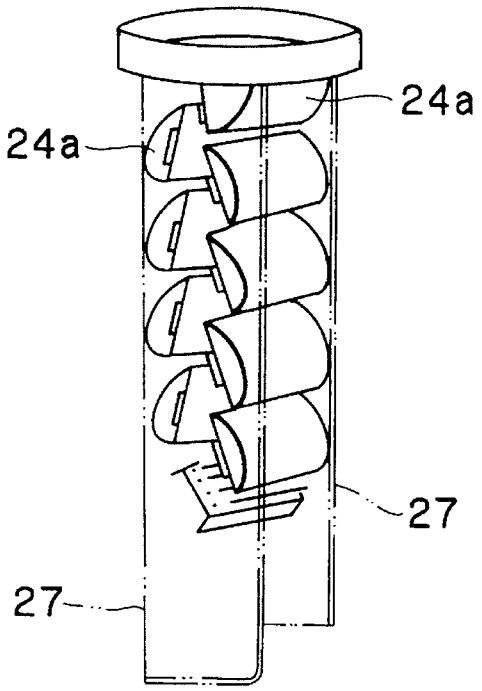
FIG. 7B is a schematic cross-sectional view showing a portion of the photomultiplier tube shown in FIG. 7A.

Also, FIGS. 7A and 7B show that the same results can be obtained when the insulation material for supporting the dynodes 24*a* in the photomultiplier tube is a black-colored, plate-shaped insulator 24*a*, as long as the MnO content of the black-colored insulator 24*a* is 3 wt % or less.

Figure 6:
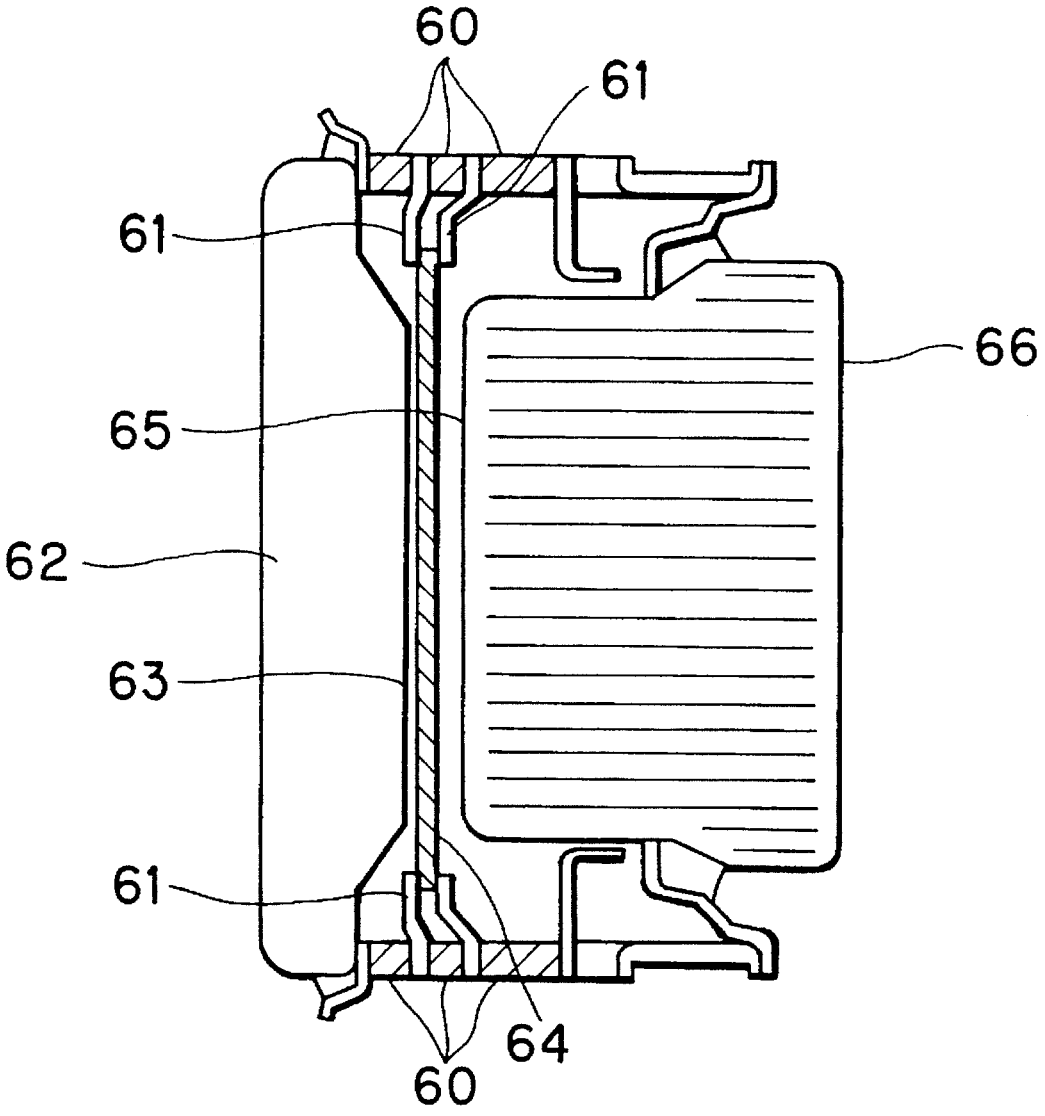
FIG. 6 is a schematic cross-schematic view showing an image intensifier as another embodiment of the present embodiment.

Although in the above-described embodiment, a photomultiplier tube was exemplified as one of the electron tubes, the present invention is not limited thereto but can also be applied to an image intensifier as shown in FIG. 6. In this case, electrode plates 61 are individually separately supported by black-colored ceramics 60 fixed to the external wall of the intensifier body. This structure allows application of high voltage. Describing the structure briefly, reference numbers 62, 63, and 64 denote an input window, a photocathode, and a micro channel plate (MCP), respectively. The electron stream multiplied at the MCP 64 is formed into a visible image on the phosphor screen 65 and outputted over a fiber optic plate (FOP) 66.

The present invention is applicable to other electron tubes insofar as alkali metal is introduced to and confined in the envelope.

As described above, an electron tube according to the present invention that uses insulation material with a MnO content of 3 wt % or less can reduce leak current that causes dark current and unusual illumination of light during photomultiplication. The present invention provides an electron tube with excellent signal-to-noise ratio.

What is claimed is:

1. An electron tube comprising:

a vessel having an inner space;

a photocathode having a surface deposited with alkali metal;

a plurality of electrodes;

an insulation member disposed in the inner space of said vessel and electrically insulating said photocathode and said plurality of electrodes, said insulation member being made of a material which absorbs little said alkali metal.

2. An electron tube according to claim 1, wherein said insulation member is made of ceramics.

3. An electron tube according to claim 2, wherein said insulation member is colored by a coloring material.

4. An electron tube according to claim 2, wherein said vessel has a conduit open to atmosphere, an alkali metal vapor being introduced through the conduit into the inner space of said vessel for depositing the alkali metal on the surface of said photocathode, said conduit being closed after a predetermined amount of the alkali metal vapor is introduced into the inner space of said vessel.

5. An electron tube comprising:

a vessel having an inner space;

a photocathode having a surface deposited with an alkali metal;

a plurality of electrodes;

an insulation member disposed in the inner space of said vessel and electrically insulating said photocathode and said plurality of electrodes, said insulation member having a manganese oxide content of 3 wt % or less.

6. An electron tube according to claim 5, wherein said insulation member is made of ceramics.

7. An electron tube according to claim 6, wherein said insulation member is colored by a coloring material.

8. An electron tube according to claim 6, wherein said vessel has a conduit open to atmosphere, an alkali metal vapor being introduced through the conduit into the inner space of said vessel for depositing the alkali metal on the surface of said photocathode, said conduit being closed after a predetermined amount of the alkali metal vapor is introduced into the inner space of said vessel.

9. An electron tube produced by introducing alkali metal vapor into a vessel, thereafter evacuating the vessel, and hermetically sealing the vessel, comprising:

a photocathode having a surface deposited with the alkali metal, said photocathode emitting electrons upon incident of radiation;

a plurality of electrodes;

multiplying means for multiplying the electrons emitted from said photocathode and producing secondary electrons;

an anode receiving the secondary electrons from said multiplying means and outputting an output signal; and an insulation member electrically insulating said photocathode, said multiplying means, and said anode, said insulation member having a MnO content of 3 wt % or less.

10. An electron tube according to claim 9, wherein said insulation member is made of ceramics.

11. An electron tube according to claim 10, wherein said insulation member is colored by a coloring material.

12. An electron tube according to claim 10, wherein said vessel has a conduit open to atmosphere, an alkali metal vapor being introduced through the conduit into the inner space of said vessel for depositing the alkali metal on the surface of said photocathode, said conduit being closed after a predetermined amount of the alkali metal vapor is introduced into the inner space of said vessel.

13. An electron tube according to claim 9, wherein the alkali metal vapor is produced from potassium.

14. An electron tube according to claim 9, wherein the alkali metal vapor is produced from rubidium.

15. An electron tube according to claim 9, wherein the alkali metal vapor is produced from caesium.

* * * * *